US007594819B2

(12) United States Patent
Araki et al.

(10) Patent No.: US 7,594,819 B2
(45) Date of Patent: Sep. 29, 2009

(54) ROTARY CONNECTOR

(75) Inventors: Shunji Araki, Miyagi-ken (JP); Yasunori Takahashi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 12/329,240

(22) Filed: Dec. 5, 2008

(65) Prior Publication Data

US 2009/0156034 A1 Jun. 18, 2009

(30) Foreign Application Priority Data

Dec. 17, 2007 (JP) ..... 2007-325045

(51) Int. Cl.
*H01R 35/04* (2006.01)

(52) U.S. Cl. ..... 439/164

(58) Field of Classification Search ..... 439/164, 439/15; 242/388

See application file for complete search history.

(56) References Cited

U.S. PATENT DOCUMENTS 5,651,687 A * 7/1997 Du-Rocher et al. ..... 439/164
5,752,844 A * 5/1998 Kawamoto ..... 439/164
5,772,146 A * 6/1998 Kawamoto et al. ..... 242/388
5,928,018 A * 7/1999 Dumoulin ..... 439/164
6,435,886 B2 8/2002 Oguma
6,764,326 B2 * 7/2004 Matsumoto et al. ..... 439/164
7,104,821 B2 * 9/2006 Araki et al. ..... 439/164

FOREIGN PATENT DOCUMENTS

JP A2 2002-58150 2/2002

* cited by examiner

*Primary Examiner*—Michael C Zarroli
(74) *Attorney, Agent, or Firm*—Brinks Hofer Gilson & Lione

(57) ABSTRACT

A rotary connector includes a stator housing in which an outer tubular body is erected at an outer edge of a bottom plate having a center hole, an upper rotor having a top plate facing the bottom plate and an inner tubular body facing the outer tubular body, and rotatably mounted on the stator housing, a lower rotor having a tubular portion inserted through the center hole towards the top plate from the bottom plate and fixed to the inner tubular body, and an annular flange protruding radially outward from the tubular portion and faces the bottom plate, and a flexible cable housed within an annular housing space formed between the stator housing and the upper rotor so as to be able to be wound and rewound, and having one end attached to the stator housing and the other end attached to the rotor. An inner edge of the bottom plate is provided with an erected portion erected in an axial direction, and the erected portion is made to face the tubular portion such that an inner peripheral surface of the erected portion becomes a sliding surface of the tubular portion, and the erected portion is arranged between a bottom of the inner tubular body and the annular flange such that axial movement of the upper rotor and the lower rotor is suppressed by the erected portion.

5 Claims, 5 Drawing Sheets

ROTARY CONNECTOR

CLAIM OF PRIORITY

The present application claims the benefit of and contains subject matter related to Japanese Patent Application Japanese Patent Application No. 2007-325045 filed in the Japanese Patent Office on Dec. 17, 2007, the entire contents which is hereby incorporated herein by reference.

BACKGROUND

1. Technical Field

The present invention relates to a rotary connector in which a stator housing and a rotor housing which are rotatably combined are electrically connected by a flexible cable, and particularly, to a rotary connector in which a rotor housing is constructed by an upper rotor and a lower rotor which are connected by snapping, etc.

2. Related Art

A rotary connector includes a stator housing fixed to an assembly of a combination switch, which is provided in a steering system of an automobile, or the like, a rotor housing attached to a steering wheel, a flexible cable housed within an annular housing space formed between these housings, and the like, and is used as an electrical connecting means, such as an air bag inflator, which is attached to a steering wheel with a limited number of revolutions.

In the related art, in such rotary connectors, a rotary connector in which an upper rotor and a lower rotor constitutes a rotor housing, and the lower rotor and the upper rotor are combined and integrated in the final stage of an assembling process, thereby enabling the stator housing to be mounted on the rotator housing is known (for example, refer to U.S. Pat. No. 6,435,886 which corresponds to Japanese Unexamined Patent Application Publication No. 2002-58150 (pages 4-6, FIG. 2)). FIG. 8 is a sectional view for explaining a schematic construction of this related-art rotary connector. The rotary connector shown in this drawing generally includes a stator housing 20, a rotor housing 21 rotatably mounted on the stator housing 20, a movable body 23 rotatably arranged within an annular housing space 22 formed between the housings 20 and 21, and a beltlike flat cable (flexible cable) 24 housed within the housing space 22 so as to be able to be wound and rewound.

The stator housing 20 is constructed by integrating an outer tubular body 25 and a bottom cover (bottom plate) 26, which are made of a synthetic resin, by snapping, etc. A holding wall 25*a* is formed at an upper end of the outer tubular body 25 so as to protrude inward, and a circular center hole 26*a* is formed in the middle of the bottom cover 26. Further, the rotor housing 21 is constructed by integrating an upper rotor 27 and a lower rotor 28 made of synthetic resin by snapping, etc., and in the upper rotor 27, a ring-shaped top plate 27*a* and an inner tubular body 27*b* which extends downward from the inner peripheral edge of the top plate are integrally formed. In the lower rotor 28, a substantially cylindrical wall portion 28*a* and a flange 28*b* which protrudes outward from a lower end of the wall portion are integrally formed, and the upper rotor 27 and the lower rotor 28 are integrated by fixing the cylindrical wall portion 28*a* to an inner wall portion of the inner tubular body 27*b* by snapping, etc. In addition, when the upper rotor 27 and the lower rotor 28 are integrated in this way, it is desirable that an outer peripheral edge of the top plate 27*a* of the upper rotor 27 is made to slidably face the upper face of the holding wall 25*a* of the outer tubular body 25, and the flange 28*b* of the lower rotor 28 is made to face the lower face of the inner peripheral edge of the bottom cover 26. By such a construction, the stator housing 20 is rotatably mounted on the rotor housing 21 in a state where axial rattling is suppressed. Further, since the outer peripheral surface of the flange 28*b* is made to face the bottom cover 26 with a required clearance, radial rattling the rotor housing 21 with respect to the stator housing 20 is suppressed.

The movable body 23 and the flat cable 24 are housed within the housing space 22. The movable body 23 is constituted by a plurality of rollers 23*a* and a ring-shaped rotary plate (roller holder) 23*b*, and the rotary plate 23*b* molded from synthetic resin is rotatably placed on an upper face of the bottom cover 26. Each roller 23*a* is rotatably supported on the upper face of the rotary plate 23*b*. Further, the flat cable 24 is reversed in winding direction on the way by a specific roller 23*a* in the housing space 22. In addition, although not shown, both longitudinal ends of the flat cable 24 are connected with lead blocks, and the lead blocks are respectively fixed to given positions of the stator housing 20 and the rotor housing 21. By electrically connecting an external connector or an external lead to these lead blocks, the flat cable 24 is electrically connected with an external circuit.

In the rotary connector constructed in this way, when the rotor housing 21 (the upper rotor 27 and the lower rotor 28) is rotated in any of forward and reverse directions with respect to the stator housing 20 (the outer tubular body 25 and the bottom cover 26), a reversed portion of the flat cable 24 moves in the same direction by a rotational amount smaller than the upper rotor 27, and along with this, the movable body 23 also moves in the same direction. As a result, the flat cable 24 of about twice the length of this travel distance is paid out from the inner tubular body 27*b* of the upper rotor 27, and is rewound toward the outer tubular body 25, or on the contrary, is paid out from the outer tubular body 25, and is wound toward the inner tubular body 27*b*.

In the aforementioned related-art rotary connector, axial downward movement of the rotor housing 21 is suppressed by making the outer peripheral edge of the top plate 27*a* abut on the upper face of the holding wall 25*a* of the outer tubular body 25, and axial upward movement of the rotor housing 21 is suppressed by making the lower face of the flange 28*b* of the lower rotor 28 face the upper face of the inner peripheral edge of the center hole 26*a* of the bottom cover 26. Further, radial movement of the rotor housing 21 is suppressed within a predetermined range by making the outer peripheral edge of the top plate 27*a* face the holding wall 25*a* of the outer tubular body 25 radially, and making the outer peripheral edge of the flange 28*b* of the lower rotor 28 face the bottom cover 26 radially. However, since the outer peripheral edge of the top plate 27*a* is largely separated from the rotation center of rotor housing 21, under the influence of thermal expansion or the like during resin molding or at high temperature, the outer peripheral edge of the top plate 27*a* tends to cause deformation such as warpage, or positional deviation during rotation, and the rotational speed of the outer peripheral edge of the top plate 27*a* is comparatively larger than other portions. Therefore, during the rotation of the rotor housing 21, the outer peripheral edge of the top plate 27*a* stops sliding smoothly with respect to the holding wall 25*a* of the outer tubular body 25. As a result, there is a problem in that abnormal noises are generated from a sliding portion.

SUMMARY

According to one embodiment, there is provided a rotary connector including a stator housing in which an outer tubular body is erected at an outer edge of a bottom plate having a center hole; an upper rotor having a top plate facing the bottom plate and an inner tubular body facing the outer tubular body, and rotatably mounted on the stator housing. A lower rotor has a tubular portion inserted through the center hole towards the top plate from the bottom plate and is fixed to the inner tubular body, and an annular flange protrudes radially outward from the tubular portion and faces the bottom plate. A flexible cable is housed within an annular housing space formed between the stator housing and the upper rotor so as to be able to be wound and rewound, and having one end attached to the stator housing and the other end attached to the rotor. Here, an inner edge of the bottom plate is provided with an erected portion erected in an axial direction, and the erected portion is made to face the tubular portion such that an inner peripheral surface of the erected portion becomes a sliding surface of the tubular portion, and the erected portion is arranged between a bottom of the inner tubular body and the annular flange such that axial movement of the upper rotor and the lower rotor is suppressed by the erected portion.

In the rotatable connector constructed in this way, the erected portion provided at the inner edge of the bottom plate of the stator housing is sandwiched between the inner tubular body and the annular flange, in the vicinity of the center of rotation where any deformation such as warpage caused by the influence of thermal expansion during resin molding, at high temperature, or the like or any positional deviation during rotation is little, and rotational speed are comparatively small. Therefore, axial movement of the rotor housing with respect to the stator housing can be suppressed. Further, since the erected portion becomes a sliding surface of the tubular portion of the lower rotor, radial movement of the rotor housing with respect to the stator housing can be suppressed, and consequently, generation of abnormal noises from a sliding portion between the stator housing and the rotor housing can be suppressed.

DESCRIPTION OF EXEMPLARY EMBODIMENTS

Figure 1:
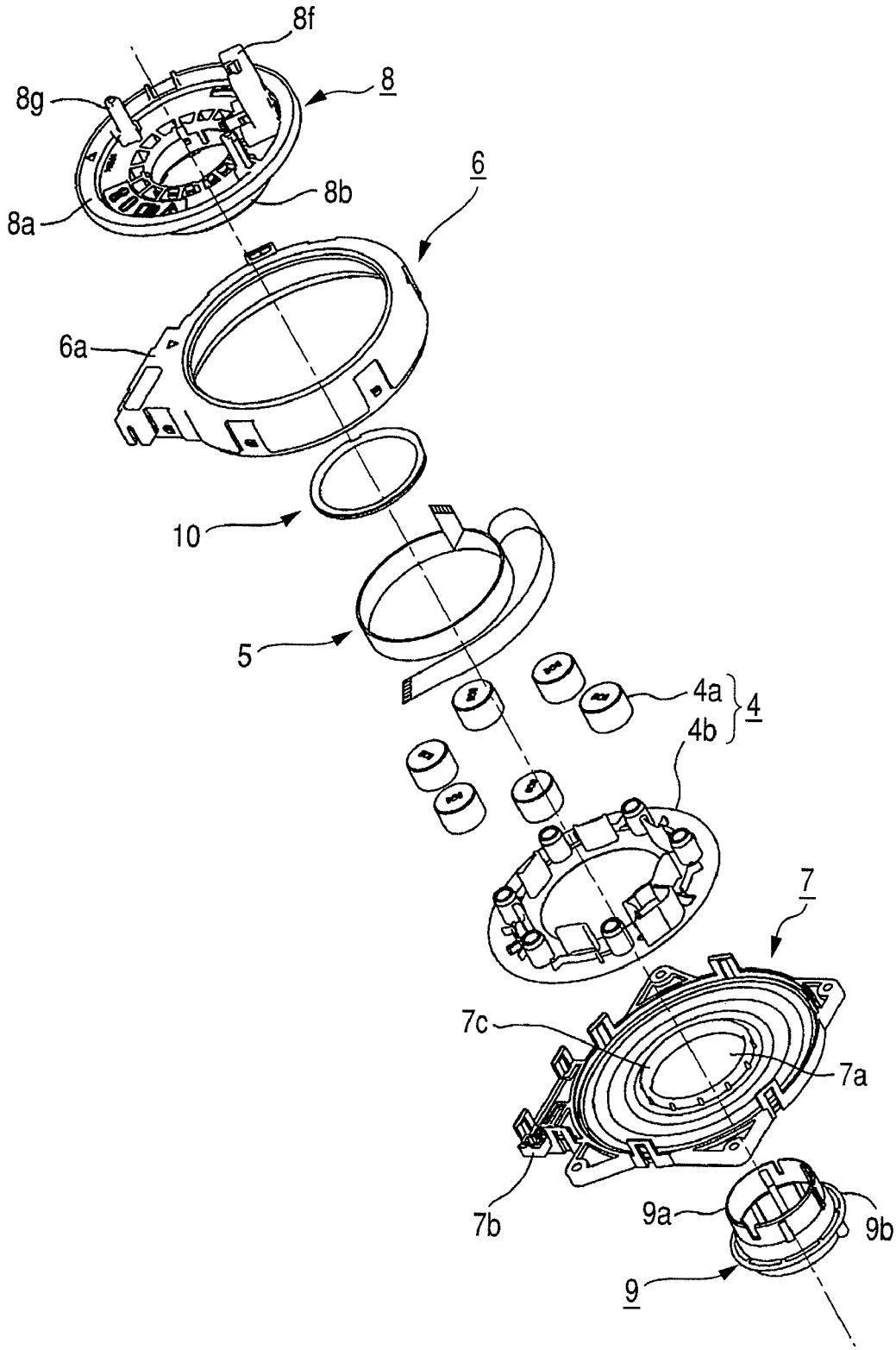
FIG. 1 is an exploded perspective view of a rotary connector according to an embodiment of the invention.
Figure 2:
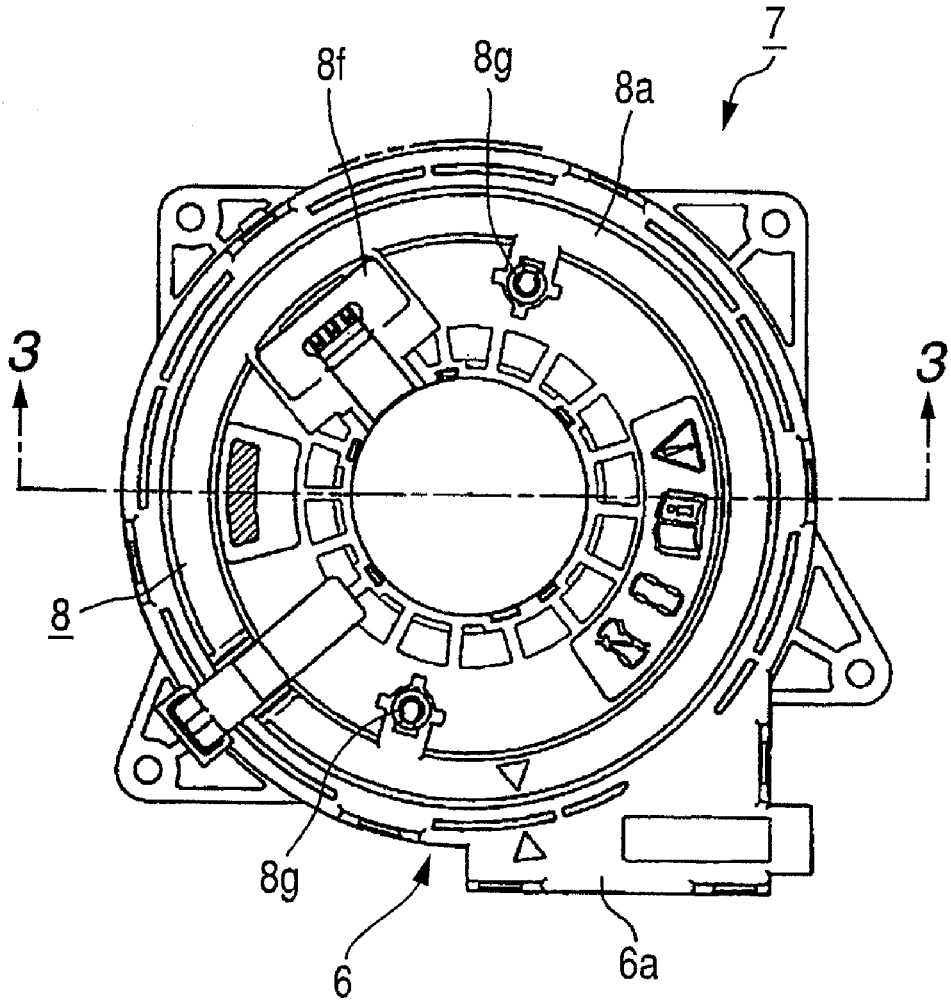
FIG. 2 is a top view of the rotary connector of FIG. 1.
Figure 3:
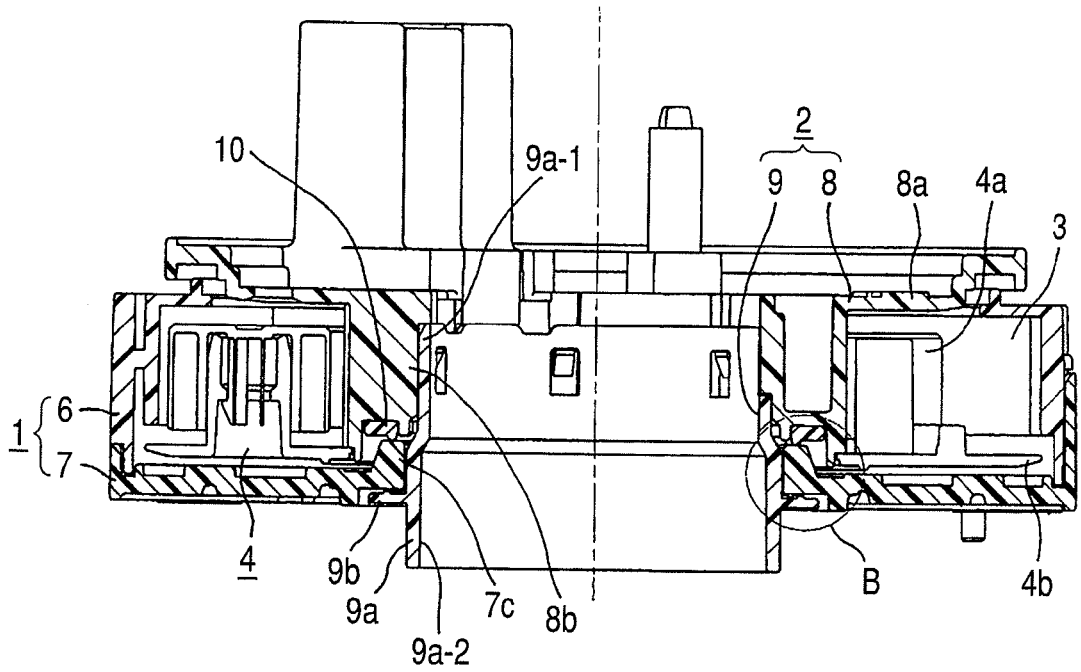
FIG. 3 is a sectional view taken along a line A-A of FIG. 2.
Figure 4:
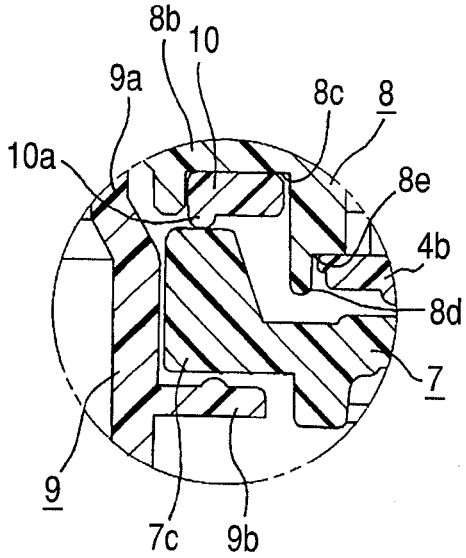
FIG. 4 is an enlarged view of a portion B of FIG. 3.
Figure 5:
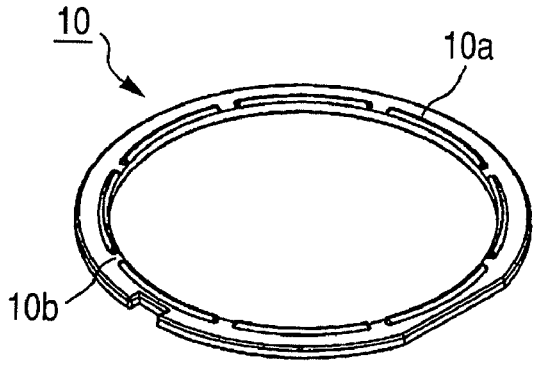
FIG. 5 is a perspective view showing the shape of a bottom face of a ring member used for the rotary connector of FIG. 1.
Figure 6:
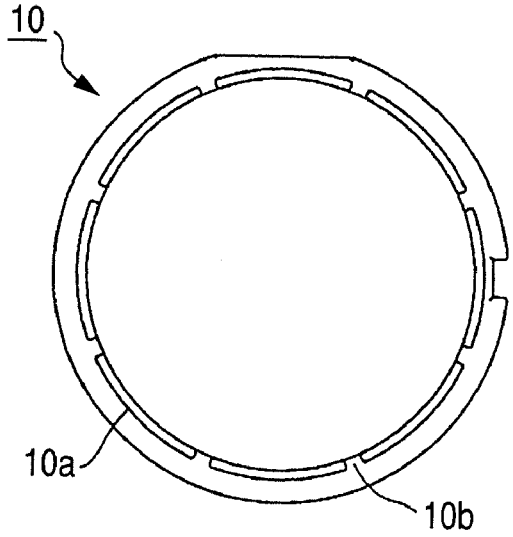
FIG. 6 is a bottom view of the ring member of FIG. 5.
Figure 7:
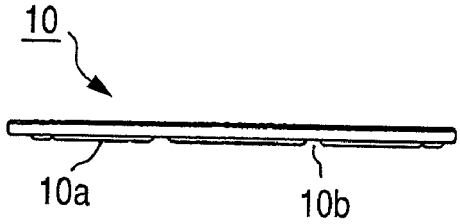
FIG. 7 is a side view of the ring member of FIG. 5.
Figure 8:
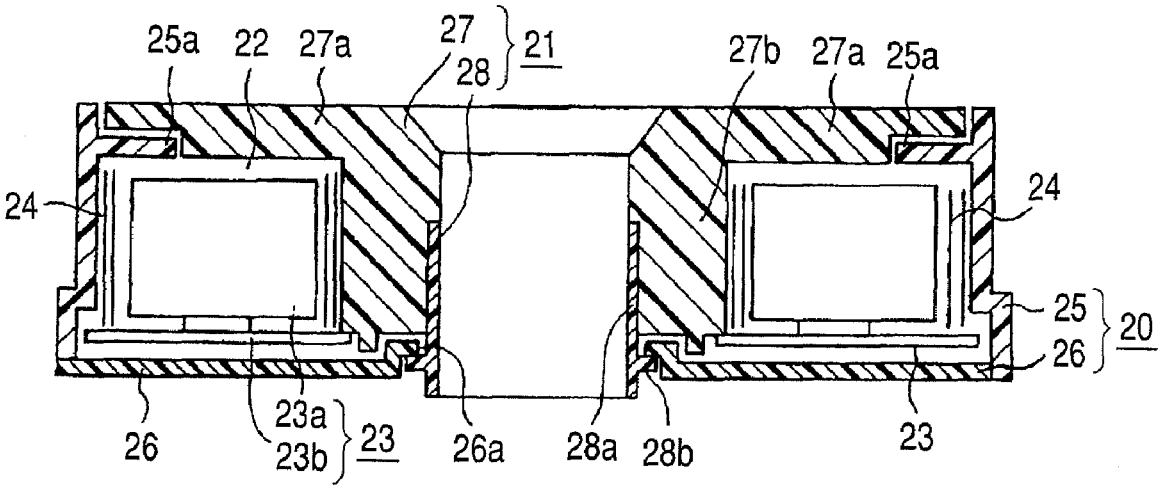
FIG. 8 PRIOR ART
FIG. 8 is a sectional view of a rotary connector according to a related-art example.

Now, an embodiment of the invention will be described with reference to the drawings in which FIG. 1 is an exploded perspective view of a rotary connector according to an embodiment of the invention, FIG. 2 is a top view of the rotary connector of FIG. 1, FIG. 3 is a sectional view taken along a line A-A of FIG. 2, FIG. 4 is an enlarged view of a portion B of FIG. 3, FIG. 5 is a perspective view showing the shape of a bottom face of a ring member used for the rotary connector of FIG. 1, FIG. 6 is a bottom view of the ring member of FIG. 5, and FIG. 7 is a side view of the ring member of FIG. 5.

The rotary connector according to this embodiment generally includes a stator housing 1, a rotor housing 2 rotatably mounted on the stator housing 1, a movable body 4 rotatably arranged within an annular housing space 3 formed between the housings 1 and 2, and a beltlike flat cable (flexible cable) 5 housed within the housing space 3 so as to be able to be wound and rewound.

The stator housing 1 is made of synthetic resin, and is constructed by integrating an outer tubular body 6 made of POM (polyacetal), and a bottom cover (bottom plate) 7 made of PBT (polybutylene terephthalate) by snapping, etc. A lid portion 6*a* and a plurality of attachment pieces (not shown) are integrally formed at an outer peripheral portion of the outer tubular body 6, and these attachment pieces are screwed to an assembly of a combination switch of a steering system, or the like. A circular center hole 7*a* is formed in the middle of the bottom cover 7, and a holding portion 7*b* is integrally formed in a position corresponding to the lid portion 6*a* at an outer peripheral portion of the bottom cover 7. Further, an annular erected portion 7*c* which is erected in the axial direction is formed at an inner edge of the bottom cover 7. In addition, in this embodiment, the outer tubular body 6 and the bottom cover 7 which are molded separately are integrated by snapping, etc. However, it is also possible to integrally mold the outer tubular body 6 and the bottom cover 7.

The rotor housing 2 is made of synthetic resin, and is constructed by integrating an upper rotor 8 made of PBT (polybutylene terephthalate), and a lower rotor 9 made of PP (polypropylene) by snapping, etc. In this regard, a ring member 10 made of POM (polyacetal) is fixed to the bottom of the upper rotor 8. In the upper rotor 8, a ring-shaped top plate 8*a*, and an inner tubular body 8*b* which extends downward from the inner peripheral edge of the top plate are integrally formed. As shown in FIG. 4, an annular recess 8*c* is formed near an inner peripheral edge of the inner tubular body 8*b* at the bottom face thereof, and a plurality of arcuate projections 8*d* are formed outside the annular recess 8*c*. The annular recess 8*c* extends annularly over its entire periphery, and the ring member 10 is fixed into the annular recess 8*c* by proper means, such as press fitting. The arcuate projections 8*d* are distributed along an outer peripheral edge of the annular recess 8*c*, and a stepped portion 8*e* is formed at outer peripheral portions of the projections. Here, the arcuate projection 8*d* may be continuously formed in the peripheral direction, and the stepped portion 8*e* is formed along the arcuate projection 8*d* at an outer peripheral lower end of the inner tubular body 8*b*, i.e., below a side portion of the inner tubular body 8*b* facing the housing space 3. In addition, a holding wall 8*f* and a plurality of driving pins 8*g* are erected at the top plate 8*a* of the upper rotor 8. By making the driving pins 8*g* engaged with a steering wheel (not shown), the torque of the steering wheel is transmitted to the upper rotor 8 via the driving pins 8*g*.

As shown in FIGS. 5 to 7, the bottom face of the ring member 10 is formed with a plurality of substantially annular pier portions (protruding portions) 10*a* which extend in the peripheral direction and are divided by recessed stepped portions 10*b*. As shown in FIG. 4, the pier portions 10*a* are adapted come into sliding contact with a top face of the erected portion 7*c* of the bottom cover 7. Grease for enhancing sliding characteristics is applied to the pier portions 10*a* of the ring member 10. The surroundings of the pier portions 10*a*, especially the recessed stepped portions 10*b* are adapted to function as grease reservoirs. With the rotation of the rotor housing 2, the grease accumulated in the recessed stepped portions 10*b*, etc. is always supplied to between the pier portions 10*a* and the erected portion 7*c*.

On the other hand, in the lower rotor 9, a substantially cylindrical tubular portion 9*a* and an annular flange 9*b* which protrudes radially outward from an outer peripheral surface of the tubular portion is integrally formed. The tubular portion 9*a* is inserted through the center hole 7*a* of the bottom cover 7 towards the top plate 8*a* from the bottom cover (bottom plate) 7, and is fixed to the inner tubular body 8*b* of the upper rotor 8 by snapping, etc. Thereby, the upper rotor 8 and the lower rotor 9 are integrated in a state where the erected portion 7*c* of the bottom cover 7 is arranged so as to be sandwiched between the inner tubular body 8*b* and the annular flange 9*b*, (refer to FIG. 3).

That is, the upper rotor 8 and the lower rotor 9 are assembled together such that the stator housing 1 is sandwiched in up-down directions, thereby forming an integral rotor housing 2. At this time, the pier portions 10*a* of the ring member 10 come into sliding contact with the top face of the erected portion 7*c* of the bottom cover 7, and the annular flange 9*b* is arranged so as to face the bottom face of the erected portion 7*c* with a required clearance, and the erected portion 7*c* of the bottom cover 7 is arranged between the bottom of the inner tubular body 8*b* and the annular flange 9*b* which constitute the rotor housing 2. Therefore, axial movement of the rotor housing 2 (the upper rotor 8 and the lower rotor 9) is suppressed by the erected portion 7*c*. Further, since the inner peripheral surface of the tubular portions 9*a* and the outer peripheral surface of the erected portion 7*c* and are arranged to face each other such that the inner peripheral surface of the erected portion 7*c* of the bottom cover 7 become a sliding surface of the tubular portion 9*a* of the lower rotor 9, radial movement of the rotor housing 2 is suppressed by the erected portion 7*c*. Therefore, generation of abnormal noises from a sliding portion between the stator housing 1 and the rotor housing 2 can be suppressed.

In addition, the tubular portion 9*a* of the lower rotor 9 is formed by continuously providing an upper tubular portion 9*a*-1 which is fitted into the inner tubular body 8*b* of the upper rotor 8, and a lower tubular portion 9*a*-2 which extends downward from the upper tubular portion 9*a*-1 and faces the erected portion 7*c*, and the outer diameter of lower tubular portion 9*a*-2 is set to be more larger than the outer diameter of upper tubular portion 9*a*-1. Thus, even in a case where the radial position of a canceling projection (not shown) provided in the rotor housing 2 is largely separately from the outer peripheral portion of a steering shaft (not shown) to be mounted on the rotor housing 2, the upper tubular portion 9*a*-1, the lower tubular portion 9*a*-2, and a connecting portion between thee upper tubular portion 9*a*-1 and the lower tubular portion 9*a*-2 can be formed so as to have almost uniform thickness. Accordingly, the lower rotor 9 with no deformation can be molded with high-precision dimensions, and generation of abnormal noises from a sliding portion between the rotor housing 1 and the stator housing 2 can be more effectively suppressed.

The housing space 3 is formed by the outer tubular body 6 and bottom cover 7 of the stator housing 1, and the top plate 8*a* and inner tubular body 8*b* of the rotor housing 1, and the movable body 4 and the flat cable 5 are housed within the housing space 3. The movable body 4 is constituted by a plurality of rollers 4*a* and a ring-shaped rotary plate (roller holder) 4*b*, and the rotary plate 4*b* molded from synthetic resin is rotatably placed on an upper face of the bottom cover 7. Since an inner peripheral portion of the rotary plate 4*b* is engaged with the arcuate projections 8*d* and the stepped portion 8*e* of the inner tubular body 8*b*, the position of the rotary plate 4*b* is regulated in the axial and radial directions (refer to FIG. 4). In addition, the stepped portion 8*e* is formed along the outer peripheral portions of the arcuate projections 8*d* at the outer peripheral lower end of the inner tubular body 8*b*. Each roller 4*a* is rotatably supported on the upper face of the rotary plate 4*b*. Further, the flat cable 5 is reversed in winding direction on the way by a specific roller 4*a* within the housing space 3. Both longitudinal ends of the flat cable 5 are connected with lead blocks (not shown), respectively. One lead block is fixed in the holding portion 7*b* of the bottom cover 7, and is covered with the lid portion 6*a* of the outer tubular body 6, and the other lead block is fixed in the holding wall 8*f* of the upper rotor 8. By electrically connecting an external connector or an external lead to these lead blocks, the flat cable 5 is electrically connected with an external circuit.

In addition, the erected portion 7*c* is not arranged such that the stepped portion 8*e* is engaged with the erected portion 7*c*, but as shown in FIG. 4, is arranged nearer the radial inside than the stepped portion 8*e*, i.e., more radially inside than the arcuate projections 8*d* of the inner tubular body 8*b*. Thus, even if the axial guide length of the rotor housing 2 to the stator housing 1 is increased by increasing the dimension of an inside portion of the erected portion 7*c* in its height direction, it is possible to suppress the dimension of a rotary connector in its height direction low.

The rotary connector constructed in this way is assembled into a steering system of an automobile, and is used. In this case, the stator housing 1 (the outer tubular body 6 and the bottom cover 7) is fixed to an assembly of a combination switch, or the like. Further, as for rotor housing 2, a steering shaft is sheathed with the tubular portion 9*a* of the lower rotor 9, and the driving pins 8*g* of the upper rotor 8 are engaged with a steering wheel.

When a driver rotationally operates the steering wheel clockwise or counterclockwise, the torque of the steering wheel is transmitted to the upper rotor 8 via the driving pins 8*g*. Therefore, the rotor housing 2 rotates clockwise or counterclockwise with respect to stator housing 1. For example, when the upper rotor 8 rotates clockwise from the neutral position of the steering wheel, the reversed portion of the flat cable 5 moves clockwise by a rotational amount smaller than the upper rotor 8, and along with this, the movable body 4 through which the reversed portion of the flat cable 5 pass also moves clockwise. As a result, the flat cable 5 of about twice the length of this travel distance is paid out from the inner tubular body 8*b* of the upper rotor 8 within the housing space 3, and is rewound toward the outer tubular body 6. In contrast, when the upper rotor 8 rotates counterclockwise from the neutral position of the steering wheel, the reversed portion of the flat cable 5 moves counterclockwise by a rotational amount smaller than the upper rotor 8, and along with this, the movable body 4 also moves counterclockwise. As a result, the flat cable 5 of about twice the length of this travel distance is paid out from the outer tubular body 6 within the housing space 3, and is rewound toward the inner tubular body 8*b*.

As described above, in the rotary connector according to this embodiment, the erected portion 7*c* provided at the inner edge of the bottom cover 7 of the stator housing 1 is constructed so as to be sandwiched between the bottom of the inner tubular body 8*b* of the rotor housing 2, and the annular flange 9*b*, in the vicinity of the center of rotation where any deformation such as warpage caused by the influence of thermal expansion during resin molding, at high temperature, or the like or any positional deviation during rotation is little, and rotational speed are comparatively small. Therefore, axial movement of the upper rotor 8 and the lower rotor 9 can be suppressed. Further, since the erected portion 7*c* becomes a sliding surface of the tubular portion 9*a* of the lower rotor 9, radial movement of the rotor housing 2 with respect to the stator housing 1 can be suppressed, and consequently, abnormal noises from a sliding portion between the stator housing 1 and the rotor housing 2 are hardly generated.

Moreover, in this rotary connector, the ring member 10 made of a synthetic resin material which is different from the bottom cover 7 of the stator housing 1 is fixed to the annular recess 8*c* provided at the bottom face of the inner tubular body 8*b* of the upper rotor 8. Therefore, generation of sliding noises can be made more difficult by molding the upper rotor 8 and the bottom cover 7 from the same synthetic resin material, and forming the ring member 10 from a resin material having a smaller frictional resistance than this synthetic resin, thereby making the sliding between the stator housing 1 and the rotor housing 2 smooth. Further, since the upper rotor 8 and the bottom cover 7 can be molded from the same synthetic resin material, setting of manufacture conditions also becomes easy, and consequently, manufacturing efficiency can be enhanced.

Further, in the rotary connector according to this embodiment, the bottom face of the ring member 10 is formed with a plurality of substantially annular pier portions 10*a* which extend in the peripheral direction, and are divided, and grease is applied to the plurality of pier portions 10*a*. Thus, the recessed stepped portions 10*b* formed between the pier portions 10*a* of the ring member 10 which come into sliding contact with the erected portion 7*c* functions as a grease reservoir, and consequently, the ring member 10 can be made to very smoothly slide on the erected portion 7*c* for a prolonged period of time. Further, as shown in FIG. 4, the erected portion 7*c* is arranged nearer the radial inside than the stepped portion 8*e*, i.e., more radially inside than the arcuate projections 8*d* of the inner tubular body 8*b*. Thus, even if the axial guide length of the rotor housing 2 to the stator housing 1 is increased by increasing the dimension of an inside portion of the erected portion 7*c* in its height direction, it is possible to suppress the dimension of a rotary connector in its height direction low.

In addition, in the above embodiment, the ring member 10 is fixed to the inner tubular body 8*b* of the upper rotor 8, and the ring member 10 is bought into sliding contact with the erected portion 7*c* of the bottom cover 7. However, in a case where the upper rotor 8 is molded from a synthetic resin material which is different from the bottom cover 7, it is also possible to omit the ring member 10 to bring the bottom face of the inner tubular body 8*b* into sliding contact with the erected portion 7*c* directly.

It should be understood by those skilled in the art that various modifications, combinations, sub-combinations and alternations may occur depending on design requirements and other factors insofar as they are within the scope of the appended claims of the equivalents thereof.

What is claimed is:

1. A rotary connector comprising:

a stator housing in which an outer tubular body is erected at an outer edge of a bottom plate having a center hole;

an upper rotor having a top plate facing the bottom plate and an inner tubular body facing the outer tubular body, and rotatably mounted on the stator housing;

a lower rotor having a tubular portion inserted through the center hole towards the top plate from the bottom plate and fixed to the inner tubular body, and an annular flange protruding radially outward from the tubular portion and faces the bottom plate; and a flexible cable housed within an annular housing space formed between the stator housing and the upper rotor so as to be able to be wound and rewound, and having one end attached to the stator housing and the other end attached to the rotor, wherein an inner edge of the bottom plate is provided with an erected portion erected in an axial direction, and the erected portion is made to face the tubular portion such that an inner peripheral surface of the erected portion becomes a sliding surface of the tubular portion, and the erected portion is arranged between a bottom of the inner tubular body and the annular flange such that axial movement of the upper rotor and the lower rotor is suppressed by the erected portion.

2. The rotary connector according to claim 1, wherein a ring member which is a molded product of a synthetic resin material which is different from the bottom plate is fixed to an annular recess provided at a bottom face of the inner tubular body, and the ring member is brought into sliding contact with the erected portion.

3. The rotary connector according to claim 2, wherein the bottom face of the ring member is formed with a plurality of protruding portions, and the protruding portions are brought into sliding contact with a top face of the erected portion.

4. The rotary connector according to claim 1, wherein a rotary plate which rotatably supports a plurality of rollers is housed within the housing space, an outer peripheral lower end of the inner tubular body is provided with a stepped portion which engages an inner peripheral portion of the rotary plate, the flexible cable is reversed by at least one of the plurality rollers, and the erected portion is arranged radially inside the stepped portion.

5. The rotary connector according to claim 1, wherein the tubular portion has an upper tubular portion fitted into the inner tubular body, and a lower tubular portion extending downward from the upper tubular portion and faces the erected portion, and the outer diameter of the upper tubular portion is greater than the outer diameter of the lower tubular portion.

* * * * *